US008820535B2

(12) United States Patent
Wark

(10) Patent No.: US 8,820,535 B2
(45) Date of Patent: Sep. 2, 2014

(54) CLASSIFIER WITH VARIABLE ENTRY PORTS

(76) Inventor: Rickey E. Wark, Spring, TX (US)

( * ) Notice: Subject to any disclaimer, the term of this patent is extended or adjusted under 35 U.S.C. 154(b) by 365 days.

(21) Appl. No.: 13/367,461

(22) Filed: Feb. 7, 2012

(65) Prior Publication Data

US 2013/0200187 A1 Aug. 8, 2013

(51) Int. Cl.
*B07B 4/02* (2006.01)

(52) U.S. Cl.
USPC ..... 209/139.1; 209/138; 209/143

(58) Field of Classification Search
CPC ..... B02C 23/08; B02C 23/10; B02C 23/12; B07B 4/02; B07B 7/10
USPC ..... 209/138, 139.1, 142, 143, 713, 714, 209/717, 718; 241/79; 55/455
See application file for complete search history.

(56) References Cited

U.S. PATENT DOCUMENTS

| | | | | | |
|---|---|---|---|---|---|
| 1,146,633 | A * | 7/1915 | Lyons | 209/139.2 |
| 2,064,109 | A * | 12/1936 | Hadsel | 241/40 |
| 2,868,462 | A * | 1/1959 | Bogot et al. | 241/53 |
| 4,296,864 | A * | 10/1981 | Misaka et al. | 209/135 |
| 5,055,182 | A * | 10/1991 | Lohnherr | 209/148 |
| 5,957,300 | A * | 9/1999 | Nardi et al. | 209/143 |
| 7,654,396 | B2 * | 2/2010 | Takeno et al. | 209/713 |
| 7,770,829 | B2 * | 8/2010 | Wark | 241/30 |
| 8,033,399 | B2 * | 10/2011 | Pistorius et al. | 209/713 |
| 8,517,292 | B2 * | 8/2013 | Chang | 241/56 |
| 8,622,328 | B2 * | 1/2014 | Matsumoto et al. | 241/119 |
| 2002/0079394 | A1 * | 6/2002 | Wark et al. | 241/119 |
| 2012/0138718 | A1 * | 6/2012 | Daimaru et al. | 241/79 |

* cited by examiner

*Primary Examiner* — Joseph C Rodriguez
(74) *Attorney, Agent, or Firm* — Young Basile Hanlon & MacFarlane PC

(57) ABSTRACT

Multiple embodiments of a variable flow classifier for vertical air-swept coal pulverizers are disclosed. In all embodiments, a classifier structure includes a cone with means for providing a pattern of inlet ports for introducing airborne coal to the cone wherein said means allows for selective variation in the size of the ports.

7 Claims, 6 Drawing Sheets

CLASSIFIER WITH VARIABLE ENTRY PORTS

FIELD OF THE INVENTION

The invention relates to vertical air-swept coal pulverizers and more particularly to a classifier for use in such pulverizers.

BACKGROUND OF THE INVENTION

Lump coal must be pulverized prior to use as fuel in a combustion chamber of the type frequently used to make steam in electrical power generating plants. The coal is typically pulverized using a vertical air-swept pulverizer comprising a milling bowl onto which lump coal is introduced for grinding and pulverizing by one or more large grinder or crusher wheels. Air is forced to flow upwardly through the interior of the pulverizer housing toward a classifier structure mounted near the top of the pulverizer. The primary function of the classifier is to segregate the airborne particles according to size whereby finer particles exit the pulverizer while larger particles are returned to the milling bowl for further size reduction.

It is well understood that particle size or "fineness" is an important factor in the satisfactory operation of a boiler. In general, the finer the particle size, the greater the ratio of coal particle surface area to overall fuel weight and the more efficient the combustion process. Coal particles greater in size than 300 μm are the largest contributors to unburned carbon residues and fly ash and in-chamber corrosion.

The prior art classifier is a generally cylindrical structure mounted near the top of the pulverizer housing. The larger coal particles are directed by the classifier into a cone immediately under the classifier. The classifier has circumferential intake ports of fixed size and a series of vanes inside of the ports to impart spin to the incoming airborne coal stream. In most classifiers, intake characteristics are varied by individually adjusting the vanes to different angles, a time-consuming and laborious process. In other classifiers, the vanes are interconnected by a complex linkage so they can all be adjusted as to angle in one operation. The linkage is subject to clogging and jamming and requires regular maintenance to remain operational.

SUMMARY OF THE DISCLOSURE

The invention disclosed herein is an improved classifier wherein adjustment of intake characteristics is achieved by varying the effective size or areas of the intake ports. In general, this is achieved by constructing the classifier with a shutter mechanism by which all of the intake ports in a circular array of ports can be varied in opening size with a single mechanical movement.

In one embodiment hereinafter described in detail, intake ports are formed in and around the upper portion of a classifier cone which empties onto a milling bowl. The ports are regularly spaced and can be straight up and down or slanted. A second, partial cone is fitted around the outside surface of the classifier cone in a concentric fashion and is rotatable relative to the fixed cone about a vertical center axis. The rotatable, outside cone has ports formed in it that overlie or register with the ports of the fixed inside cone. When fully in registry, the ports are fully open. As the outer cone is rotated, the degree of registry is reduced along with the effective areas of the ports.

In another embodiment, the ports are located in two overlying circular plate structures, one of which is fixed to a classifier cone and the other of which can be rotated over the fixed structure to vary the effective intake port sizes.

Other advantages, features and characteristics of the present invention, as well as methods of operation and functions of the related elements of the structure, and the combination of parts and economies of manufacture, will become more apparent upon consideration of the following detailed description with reference to the accompanying drawings, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE PRIOR AND NEW EMBODIMENTS

Figure 1:
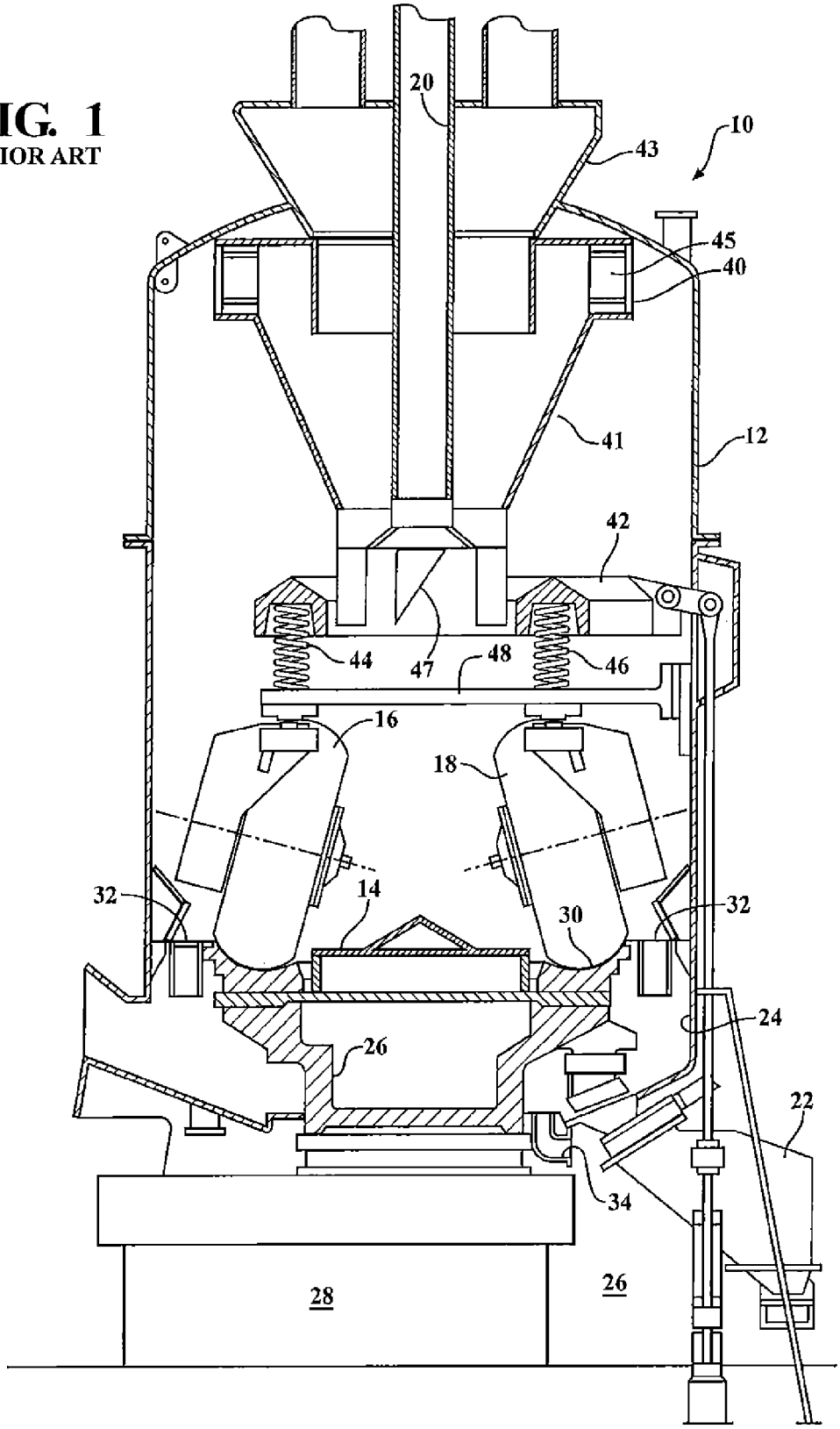
FIG. 1 PRIOR ART
FIG. 1 is a cross-sectional view of a prior art updraft pulverizer having a conventional classifier structure 40 at the top of the housing 12.

Referring first to FIG. 1, there is shown a known vertical upswept coal pulverizer 10. The pulverizer 10 comprises an upright cylindrical steel housing 12. A milling bowl 14 is mounted in the lower part of housing 12. Engaging the bowl 14 are spring-mounted crusher rollers 16 and 18. Coal is introduced by means of a vertical inlet chute 20 aligned with the vertical axis of the housing 12 and terminating in a flapper 47. Air for the updraft action is supplied to the housing 12 by means of a turbine and duct system 22 connected into a lower chamber 24 so as to flow upwardly within the housing around the outer periphery of the bowl 14. Bowl 14 rests on a heavy turret which is driven so as to rotate about a vertical axis by an electric motor and suitable reduction gears within a housing 28.

In operation, lump coal is dropped through the chute 20 onto the center of the bowl 14 and moves by centrifugal action outwardly onto surface 30 which underlies the rollers 16, 18 to effect the crushing action. The rollers are supported by a head structure 42 secured within the housing by conventional means. Springs 44, 46 resiliently urge the rollers against the milling bowl in a known manner.

Crushed material of a varying size and density moves outwardly toward an updraft air flow passing through a vane wheel 32 thereby lifting coal particles. Part of the classification function begins immediately as the heavier particles fall back onto the milling bowl 14 for further processing. Finer particles flow farther upwardly toward a classifier structure 40 having side entry ports and vanes 45. Classifier 40 is mounted on the top of a cone 41. Finer particles passing the classification function are caused to flow upwardly and outwardly by means of a conical outlet structure 43 which is connected by pipes to feed the combustion chamber of a boiler. Heavier particles fall into the cone 41 and drop back downwardly around the outside of the chute 20 and onto the milling bowl 14 for further processing. In some classifiers, the angle of the vanes 45 can be adjusted as described above. The side opening ports, however, are not adjustable at all.

The pulverizer 10 shown is representative of one of many known updraft pulverizers.

Figure 2:
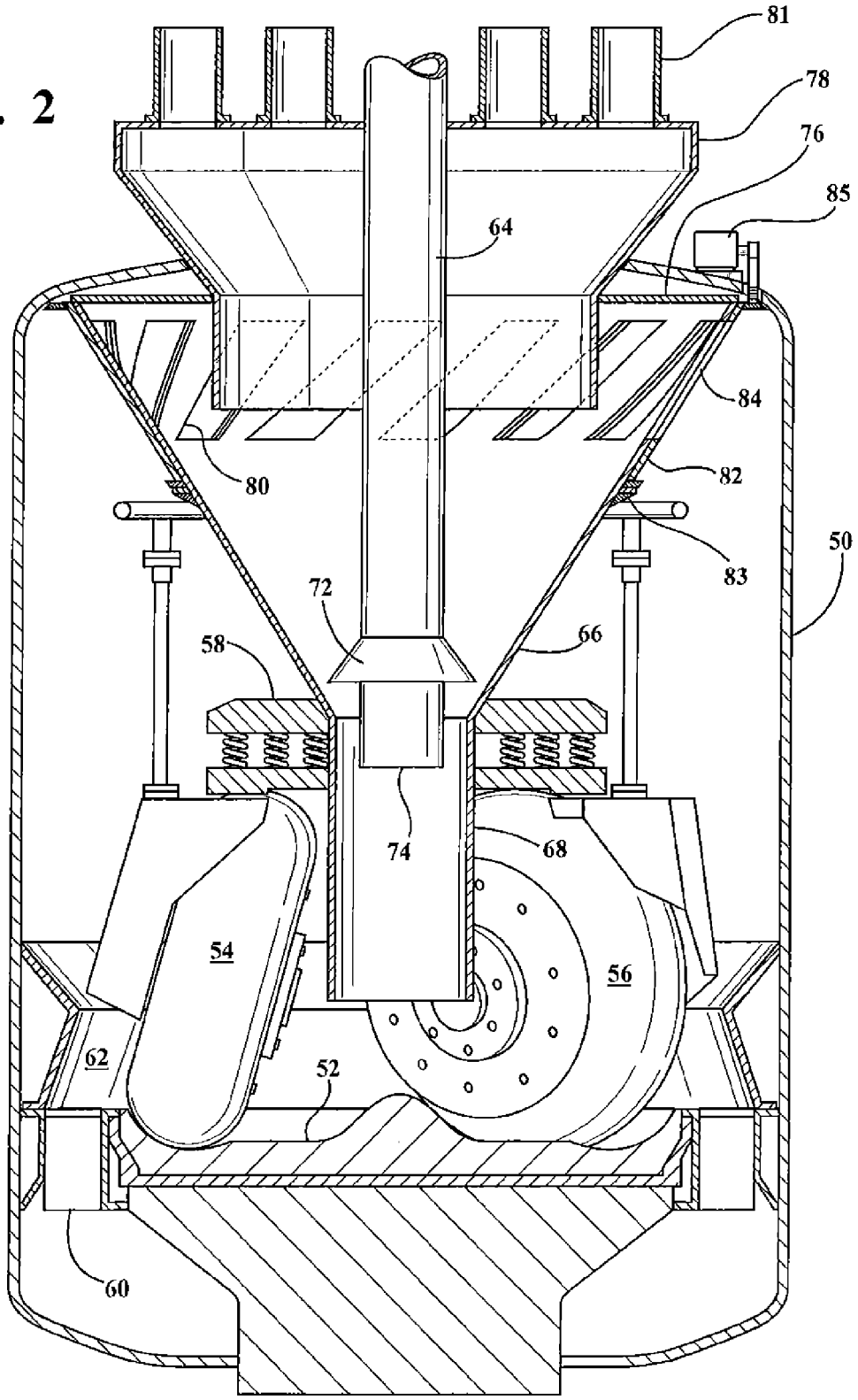
FIG. 2 is a sectional view of a first embodiment of the invention.
Figure 3:
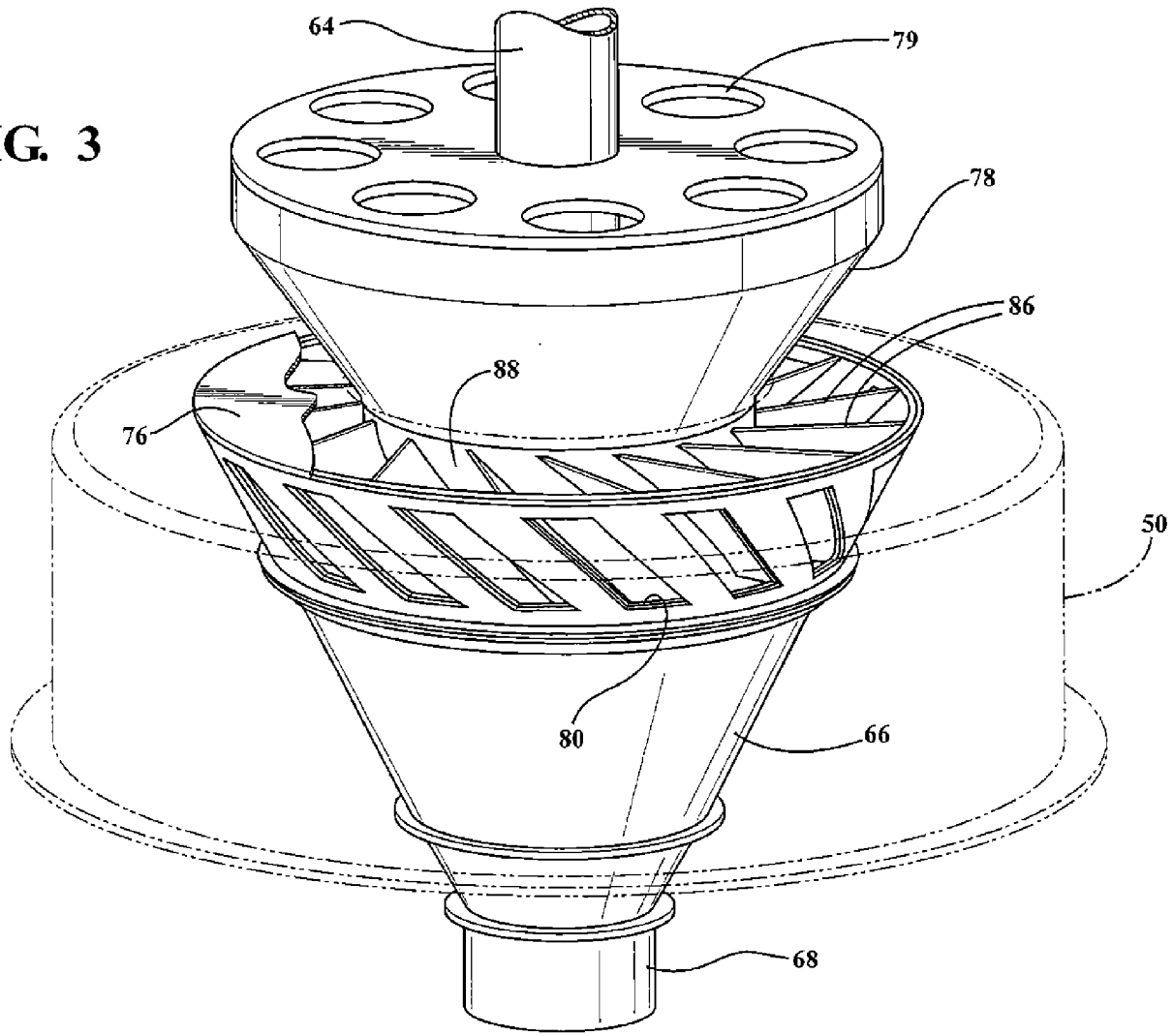
FIG. 3 is a perspective view of the embodiment of FIG. 2.

Referring to FIGS. 2 and 3, a first embodiment of my invention is shown to comprise a pulverizer having a generally cylindrical housing 50. The pulverizer shown in FIG. 2 is essentially similar to the pulverizer 10 of FIG. 1 in that it is an updraft pulverizer with a milling bowl 52 engaged by crusher rollers 54, 56 mounted for spring biased rotation relative to the milling bowl 52 by way of a suspension system 58. Updraft air is forced through an annular system of vanes 60 by conventional forced air system. The updraft air exits the vane structure 60 where it impacts a deflector 62 which causes a degree of turbulence and moves the air back toward the center of the housing 50.

Lump coal is introduced into the housing 50 by means of a vertical chute 64 which is concentrically aligned with a classifier cone 66 having a cylindrical lower section 68 projecting down between the crusher rollers 54, 56 to a point close to the milling bowl 52, a significant departure from the more conventional "flapper" outlet 47 shown on the bottom end of the inlet chute 20 of the prior art device shown in FIG. 1.

A clearance cone 72 is mounted on chute 64 just above the appoint where the chute enters the lower cone section 68. The lower portion 74 of the chute 64 projects into the lower cylindrical portion 68 of the classifier cone 66 and is smaller in diameter than the cylindrical portion 68 so as to create an annular clearance around the chute 74 and between the chute 74 and the cylinder 68. The advantages of this arrangement are more fully described in my U.S. Pat. No. 5,386,619, the content of which is incorporated herein by reference. As described there, the vertical position of the cone 72 is adjustable.

The classifier cone 66 is capped by structure 76, the cap structure 76 being welded to the top of the cone 66. An outlet structure 78 is mounted in the top of the housing 50 concentrically with the chute 64, the lower portion of the outlet structure 78 coinciding generally with the location of the venturi 70. Structure 78 has outlet openings 79 which are connected to feed pipes 81 for a boiler (not shown).

A series of regularly spaced, slanted ports 80 are formed in the upper portion of the classifier cone 66 to provide inlets for coal fines carried upwardly by the forced air system through the vanes 60 and the deflector structure 62. A second partial conical structure 82 is mounted on a flange 83 which runs around the outside of the upper portion of the classifier cone 66 to provide a bearing surface allowing the structure 82 to be rotated. The structure 82 has a set of ports 84 formed therein, the ports 84 corresponding in number, size and configuration to the ports 80 in the classifier cone 66. Structure 82 is not connected to the top 76. FIG. 2 shows the ports 80, 84 in full registration with one another; i.e., the effective areas of the inlet ports are thus maximized. However, by rotating the outer structure 82 relative to the fixed cone 66, the registration of the ports 80, 84 is changed, thus effectively reducing the areas of the inlet ports through which the coal fines flowing upwardly through the housing 50 enter the cone 66. The size reduction available is from zero to about 62%. Rotation may be achieved by a motor 85 or, if there is sufficient access to structure 82, manually. The adjustment in port size is made on an empirical basis by trained personnel monitoring the effectiveness of the boiler combustion process.

As shown in FIG. 3, vanes 86 are mounted between the fixed cone 66 and the lower cylindrical portion 88 of the outlet structure 78 to impart a tangential swirl component to the incoming airborne coal particles to aid in the classification function. Because the effective areas or sizes of the inlet ports 80, 84 can be varied, there is no need to change the angle of the vanes 86.

Figure 4:
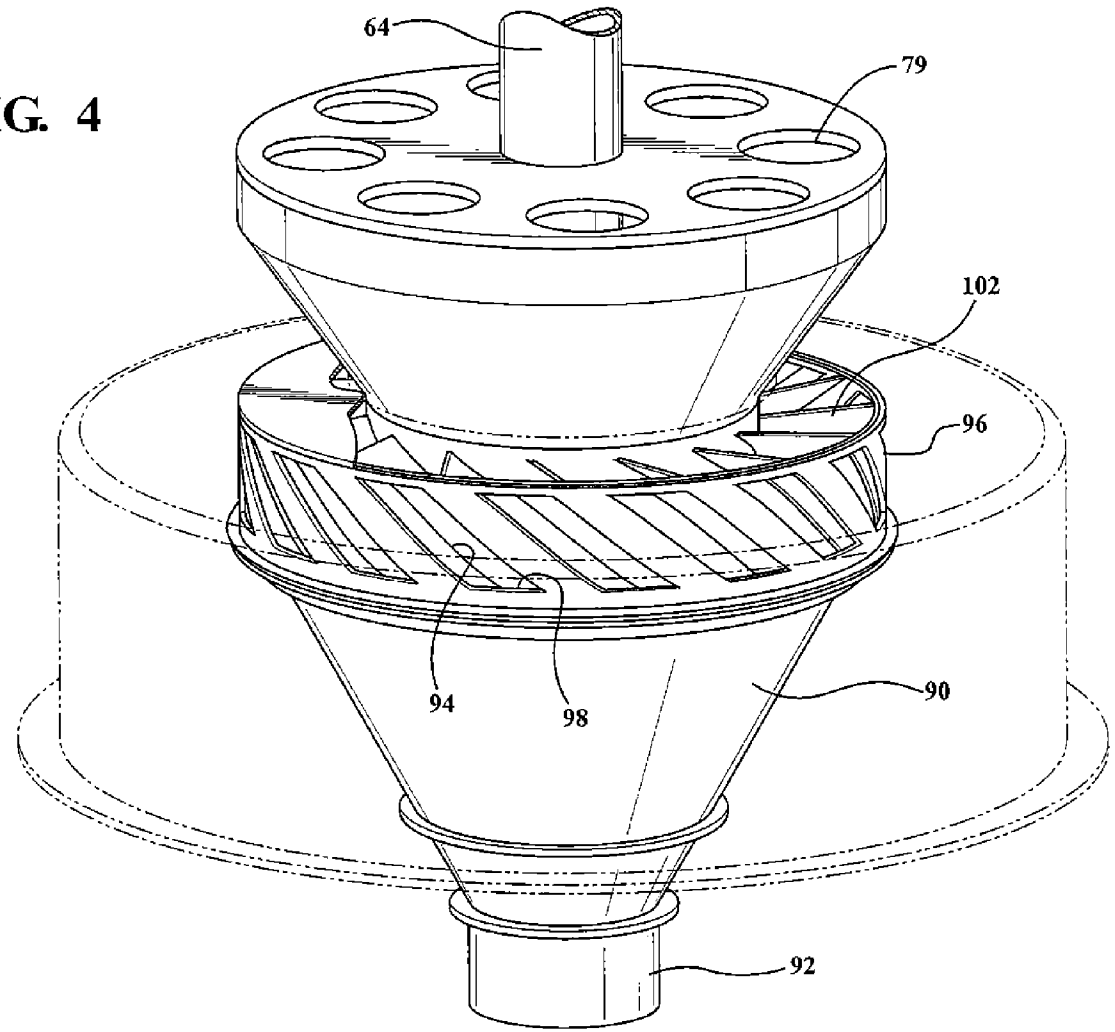
FIG. 4 is a perspective view of another embodiment of the invention.

Referring now to FIG. 4, a classifier structure similar to that of FIGS. 2 and 3 is shown, the major exception being the shape of the upper portion of the classifier cone 90 with its cylindrical lower discharge pipe 92. In this embodiment, the fixed upper portion of the cone 90 is cylindrical rather than conical and is provided with ports 94 to serve as inlets for the upwardly moving coal particles. A rotatable annular structure 96 is mounted on a bearing flange around the outside surface of the upper portion of the cone 90 and has corresponding ports 98 formed therein to register with the ports 94 in the fixed cone structure immediately within it. The cone structure 90 is connected to a cap 100 to close the structure around interior vanes 102 corresponding in number and location to the inlet ports. By rotation of the annular outer structure 96 relative to the cone, the effective sizes of the inlet ports can be adjusted by skilled personnel.

Figure 5:
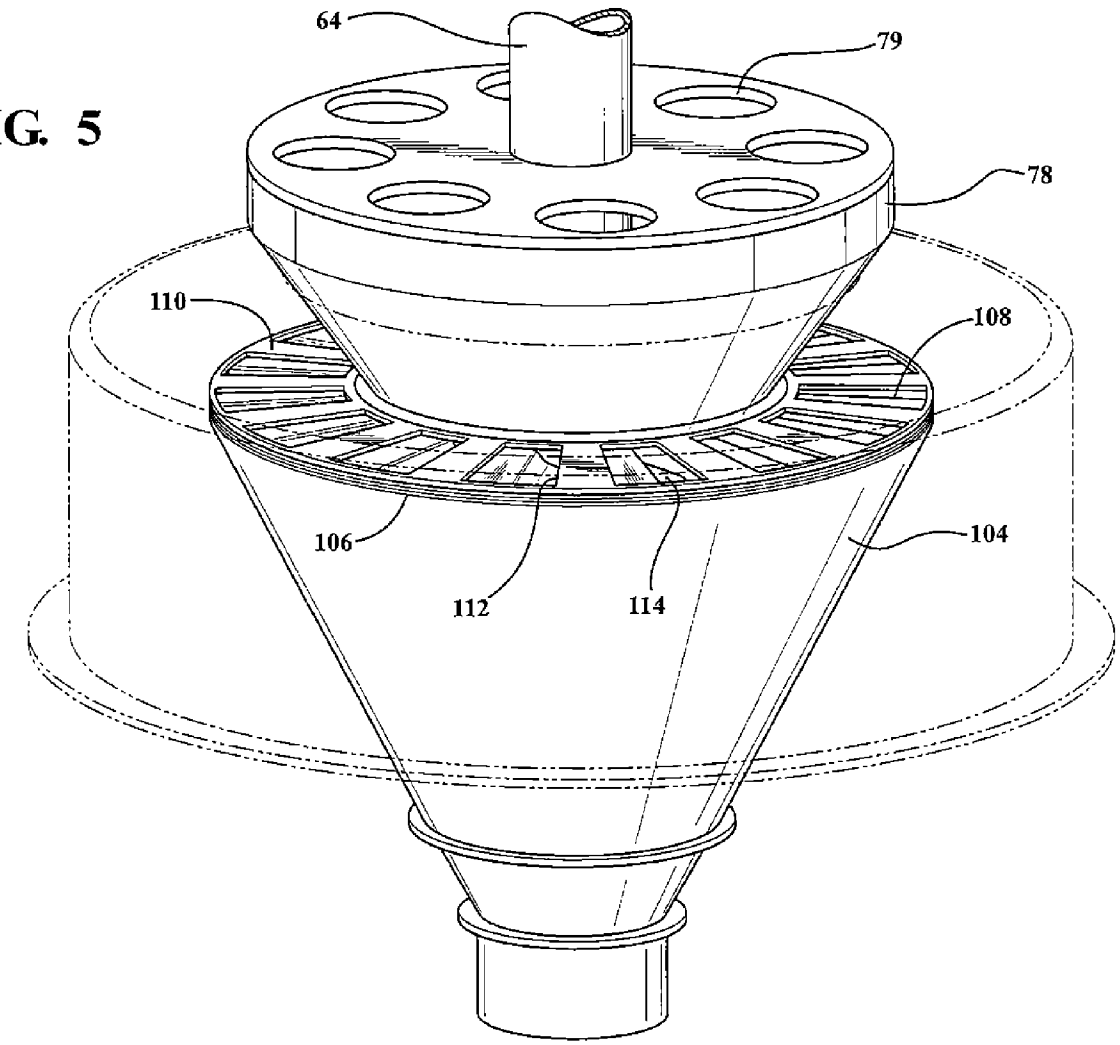
FIG. 5 is a perspective view of another embodiment of the invention.
Figure 6:
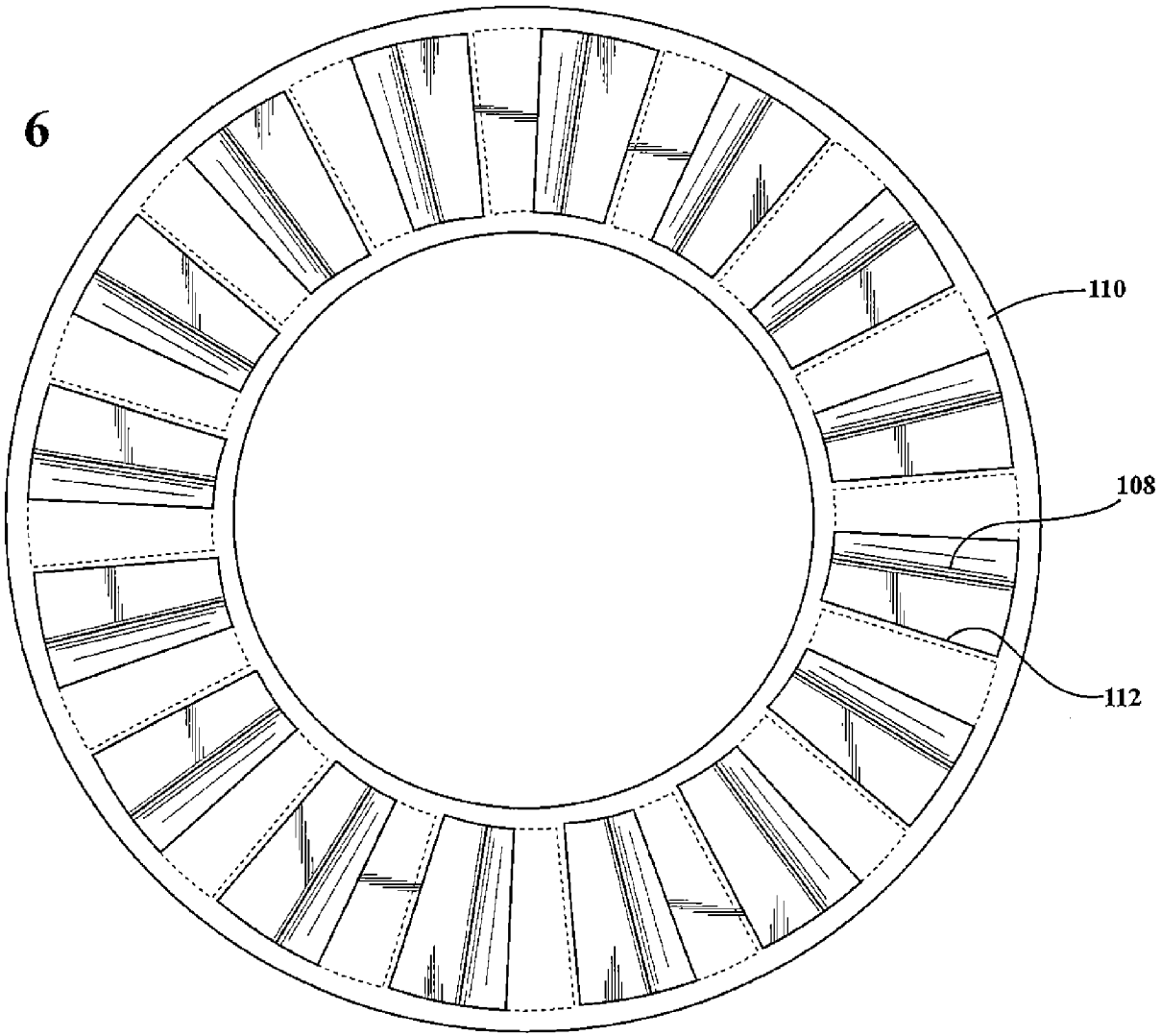
FIG. 6 is a plan view of the FIG. 5 embodiment with the intake ports partially closed.

Referring now to FIGS. 5 and 6, a still further embodiment of the invention is shown to comprise a classifier cone 104 which is mounted essentially as is the cone 66 in FIG. 2. However, in the embodiments of FIGS. 5 and 6, the classifier cone 104 is closed around the outside of the tapered conical portion. Inlet ports 108 are provided in a top cap 106 which extends inwardly to and is fixed to the lower cylindrical portion of the outlet structure 78. A rotatable circular plate structure 110 is mounted on top of and coaxial with the cap structure 106 and is provided with ports 112 which can register with the ports 108 of the fixed cap structure to vary the effective size of the inlets into the classifier cone 104. The function of the classifier structure shown in FIGS. 5 and 6 is otherwise identical to that of FIGS. 2 through 4 and vanes 114 are preferably mounted inside of the ports 106 and attach thereto to impart a swirl component to the incoming airborne particle stream. Motors can be used to rotate the structures 96 and 110 if desired.

In all of the embodiments shown and described herein, the pulverizer is operated in generally a known fashion to introduce coal in lump form onto the milling bowl for crushing by the crushing rollers 54, 56 or such other equivalent structure as may be provided. The updraft air flow system causes the flow of crushed flow particles toward the classifier structure after which the classification function is essentially as described above; i.e., the finer particles exit by way of the outlet structures 78 whereas larger, heavier particles are returned by way of the interior of the cones 66, 90 and 104 to the milling bowl for further processing.

By way of example, the width of the inlet ports 84, 94, 108 is on the order of 11 inches at the widest part and on the order of 7 inches at the narrowest part. The lengths of the ports are approximately 18½ inches and the space in between the ports is on the order of 2 to 3 inches.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A classifier for use in a vertical air swept coal pulverizer wherein the classifier comprises:

a classifier cone; and means operatively associated with the cone for providing a plurality of variable-size entry ports arranged in a circular pattern adjacent the top of the classifier cone for admitting a flow of airborne coal particles into the interior of the cone;

wherein said means comprises a first structure integral with said cone and having a first plurality of inlet ports, and a second structure rotatably mounted relative to said first structure and having a second plurality of inlet ports conformingly adjacent and variably registering with said first plurality of inlet ports.

2. The classifier as defined in claim 1 wherein the first and second structures are circular.

3. The classifier as defined in claim 1 further comprising vanes mounted adjacent the entry ports to impart spin to the incoming airborne coal particles.

4. The classifier as defined in claim 3 further including an inlet chute concentric with said cone and extending axially therethrough, said cone having a cylindrical lower portion which surrounds said chute and is larger in diameter than said chute to create an annular space therebetween.

5. The classifier as defined in claim 1 further including an outlet structure atop the classifier.

6. The classifier defined in claim 1 wherein the first structure comprises a conical body having a circumferential surface, a plurality of parallel but circumferentially spaced ports formed in circumferential surface, and said second structure comprising a conical body disposed inside of the first structure and having a circumferential surface with a plurality of ports of essentially the same shape as the ports in the first body and variable registerable with the ports in the first body.

7. The classifier defined in claim 1 wherein the first structure comprises a circular plate structure provided with a plurality of circularly arranged but spaced apart ports and mounted on the top of the classifier cone and the second body comprises a second circular plate with a plurality of ports which can register with the ports of the first plate such that the relative rotation of the two plates varies the effect of size of the inlets to the classifier cone.

* * * * *